US008999142B2

(12) United States Patent
Vannauker et al.

(10) Patent No.: US 8,999,142 B2
(45) Date of Patent: Apr. 7, 2015

(54) CATALYST AND METHOD FOR FUELS HYDROCRACKING

(75) Inventors: David L. Vannauker, Kingwood, TX (US); Richard A. Demmin, Highland Park, NJ (US)

(73) Assignee: Exxonmobil Research and Engineering Company, Annandale, NJ (US)

( * ) Notice: Subject to any disclaimer, the term of this patent is extended or adjusted under 35 U.S.C. 154(b) by 396 days.

(21) Appl. No.: 13/493,259

(22) Filed: Jun. 11, 2012

(65) Prior Publication Data

US 2012/0318712 A1 Dec. 20, 2012

Related U.S. Application Data

(60) Provisional application No. 61/497,659, filed on Jun. 16, 2011.

(51) Int. Cl.
*C10G 65/00* (2006.01)
*C10G 65/10* (2006.01)

(52) U.S. Cl.
CPC ..... *C10G 65/10* (2013.01); *C10G 2300/301* (2013.01); *C10G 2400/02* (2013.01)

(58) Field of Classification Search
CPC ..... C10G 65/02; C10G 2300/1048; C10G 2300/4031; C10G 2400/04; C10G 2400/02; C10G 2300/301
USPC ..... 208/59
See application file for complete search history.

(56) References Cited

U.S. PATENT DOCUMENTS

| | | | | |
|---|---|---|---|---|
| 3,125,502 | A * | 3/1964 | Scott | 208/59 |
| 3,239,447 | A | 3/1966 | Reeg et al. | |
| 6,783,663 | B1 * | 8/2004 | Miseo et al. | 208/213 |
| 2003/0047486 | A1 | 3/2003 | Cash et al. | |
| 2009/0045100 | A1 | 2/2009 | Yoon et al. | |

FOREIGN PATENT DOCUMENTS

WO 20111043904 A1 4/2011

* cited by examiner

*Primary Examiner* — Randy Boyer
*Assistant Examiner* — Juan Valencia
(74) *Attorney, Agent, or Firm* — Bruce M. Bordelon; Chad A. Guice; Larry E. Carter

(57) ABSTRACT

Fuels hydrocracking can be used to generate a variety of product slates. Varying the temperature can allow an amount of naphtha product and an amount of unconverted product to be varied. The method can be enabled by a hydrocracking catalyst that includes a combination of metals with activity for hydrodesulfurization.

28 Claims, 2 Drawing Sheets

CATALYST AND METHOD FOR FUELS HYDROCRACKING

This application claims priority to U.S. Provisional Application Ser. No. 61/497,659 filed Jun. 16, 2011, which is herein incorporated by reference in their entirety.

FIELD OF THE INVENTION

Catalytic methods are described below for fuels hydrocracking to make multiple fuel products.

BACKGROUND OF THE INVENTION

One method for increasing the feedstocks suitable for production of fuels can be to use cracking to convert higher boiling petroleum feeds to lower boiling products. For example, distillate boiling range feeds can be hydrocracked to generate additional naphtha boiling range products. Historically, many fuels hydrocracker reaction systems were operated to generate a maximum amount of naphtha for motor gasoline.

SUMMARY OF THE INVENTION

In one embodiment herein is a method for producing a naphtha product and an unconverted product, comprising:

exposing a first feedstock to a first hydrocracking catalyst in a first reaction vessel under first hydrocracking conditions to form a first hydrocracked effluent including at least a first liquid phase portion, at least about 60 wt % of the first feedstock boiling above about 400° F. (about 204° C.) and at least about 60 wt % of the first feedstock boiling below about 650° F. (about 343° C.), the first hydrocracking catalyst comprising Ni, Mo, and W on an acidic support, the ratio of Mo to W being from about 2:1 to about 1:2;

fractionating the first liquid phase portion and at least a portion of a second liquid phase portion to form a first naphtha fraction and a first unconverted fraction, the first naphtha fraction corresponding to at least about 80 wt % of the first feedstock and having a final boiling point of about 400° F. (about 204° C.) or less;

withdrawing a portion of the first unconverted fraction as a first unconverted product, a weight of the withdrawn first unconverted product corresponding to from about 5 wt % to about 15 wt % of the first feedstock, the withdrawn first unconverted product having an initial boiling point of at least about 400° F. (about 204° C.);

separating at least a portion of the remaining portion of the first unconverted fraction as a second feedstock;

exposing the second feedstock to a second hydrocracking catalyst in a second reactor vessel under second hydrocracking conditions to form a second hydrocracked effluent including at least the second liquid phase portion; and separating the second hydrocracked effluent to produce the second liquid phase portion;

wherein the temperature of the second hydrocracking conditions is at least about 20° F. (11° C.) less than the temperature of the first hydrocracking conditions, and wherein the temperature of the first hydrocracking conditions at start-of-run is less than about 710° F. (377° C.).

In another embodiment herein is a method for producing a naphtha product and an unconverted product, comprising:

exposing a first feedstock to a first catalyst in a first reaction vessel under hydrotreating conditions to form a first reactor effluent;

exposing at least a portion of the first reactor effluent to a first hydrocracking catalyst in a second reaction vessel under first hydrocracking conditions to form a first hydrocracked effluent;

including at least a first liquid phase portion, at least about 60 wt % of the first feedstock boiling above about 400° F. (about 204° C.) and at least about 60 wt % of the first feedstock boiling below about 650° F. (about 343° C.), and the first hydrocracking catalyst comprising Ni, Mo and W on an acidic support, the ratio of Mo to W being from about 2:1 to about 1:2;

fractionating the first liquid phase portion d at least a portion of a second liquid phase portion to form a first naphtha fraction and a first unconverted fraction, the first naphtha fraction corresponding to at least about 80 wt % of the first feedstock and having a final boiling point of about 400° F. (about 204° C.) or less;

withdrawing a portion of the first unconverted fraction as a first unconverted product, a weight of the withdrawn first unconverted product corresponding to from about 5 wt % to about 15 wt % of the first feedstock, the withdrawn first unconverted product having an initial boiling point of at least about 400° F. (about 204° C.);

separating at least a portion of the remaining portion of the first unconverted fraction as a second feedstock;

exposing the second feedstock to a second hydrocracking catalyst in a third reaction vessel under second hydrocracking conditions to form a second hydrocracked effluent including at least the second liquid phase portion; and separating the second hydrocracked effluent to produce the second liquid phase portion;

wherein the temperature of the second hydrocracking conditions is at least about 20° F. (11° C.) less than the temperature of the first hydrocracking conditions, and wherein the temperature of the first hydrocracking conditions at start-of-run is less than about 710° F. (377° C.).

DETAILED DESCRIPTION OF THE EMBODIMENTS

Overview

Figure 1:
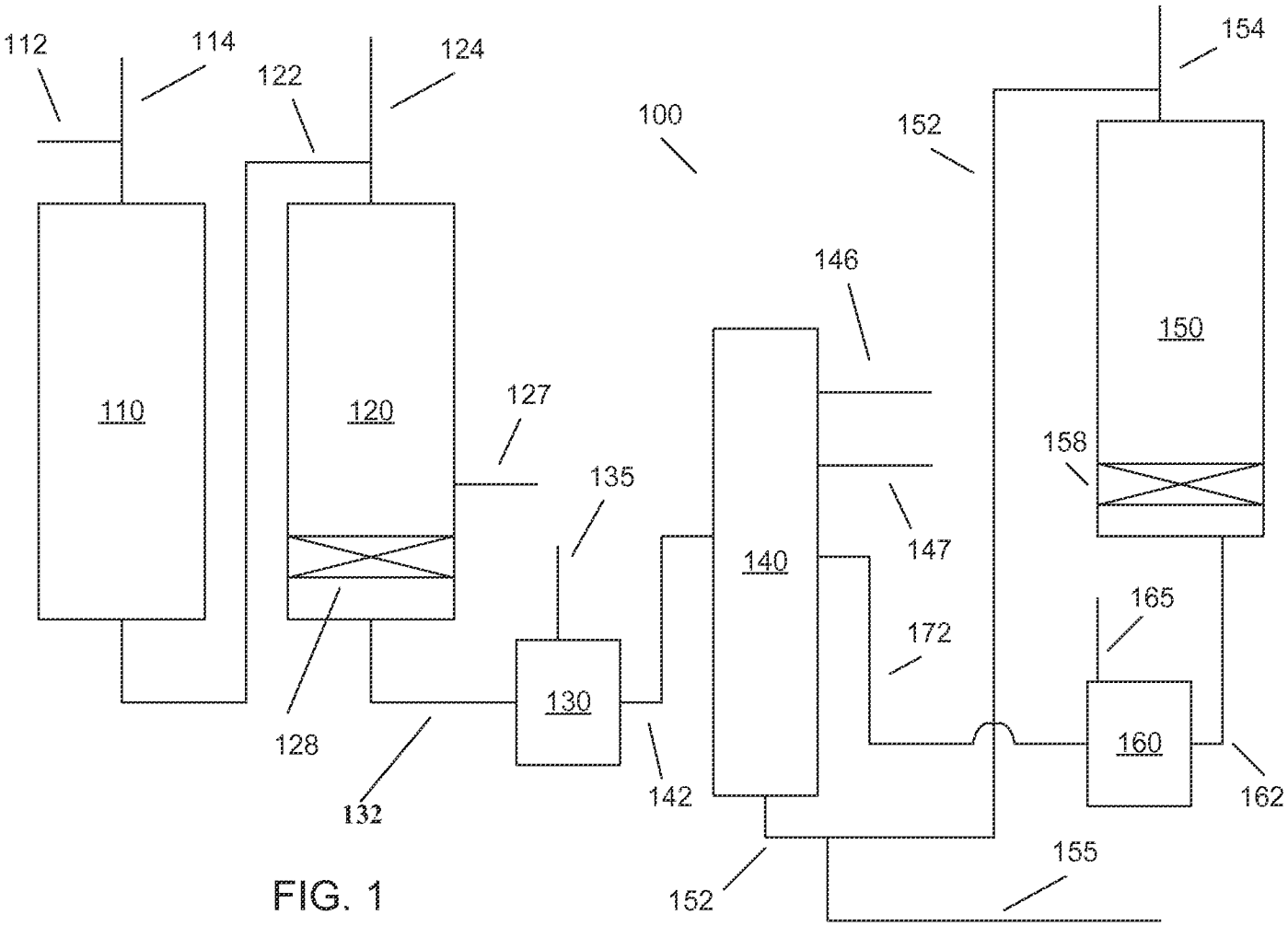
FIG. 1 schematically shows an example of a reaction system suitable for processing of a hydrocarbon feed according to the invention.

In various embodiments, methods are provided for performing fuels hydrocracking in a flexible manner. The reaction can be enabled by a catalyst can be used that allows for modification of the amount of conversion during reaction. This can allow for increased control over the amount of naphtha and diesel produced during the reaction.

Historically, many fuels hydrocracking units have been operated to provide a maximum amount of naphtha. In such units, the goal was to create naphtha to meet gasoline demand, such as in a country like the United States with a substantial motor gasoline demand. In the future, however, additional marginal refining capacity for creating naphtha may not be needed. If excess naphtha refining capacity is available, it may be beneficial to operate a fuels hydrocracking unit in a manner that produces additional diesel fuel.

One of the difficulties in operating a fuels hydrocracking unit can be achieving bath a desired level of conversion (for creating naphtha) and a desired level of sulfur removal. Conversion of feed (for creating naphtha) is typically driven by cracking functionality in a catalyst. Cracking can assist with some removal of heteroatoms such as sulfur, but typically a hydrocracking catalyst can also include additional metals with activity for hydrodesulfurization in order to meet a desired goal for heteroatom removal (e.g., desulfurization). Additionally, in order to allow for a sufficient run length between reactor turn-around events, the desired levels of cracking and heteroatom removal are preferably achieved under reaction conditions that reduce or mitigate the deterioration of the cracking/hydrodesulfurization catalyst(s).

In various embodiments, methods are provided that can allow for production of a naphtha product and an unconverted product in varying amounts. The methods can be t facilitated by use of hydrocracking catalysts having both cracking and desulfurization functionality. The desulfurization functionality can be provided by using a catalyst with supported metals, such as a combination of Group VIB and Group VIII metals. One example can be a catalyst including Ni as a Group VIII metal and a mixture of W and Mo as Group VIB metals. The W and Mo can be present in the catalyst in a molar ratio of from about 3:1 to about 1:3. Additionally, or alternately, the molar ratio of W to Mo can be about 3:1 or less, for example about 2:1 or less, about 1.5:1 or less, or about 1:1 or less. Further additionally or alternately, the molar ratio of Mo to W can be at least about 1:3, for example at least about 1:2, at least about 1:1.5, or at least about 1:1. Using a mixture of Group VIII metals can improve the desulfurization activity of a catalyst while having a reduced or minimal impact on the cracking activity of the catalyst. In some embodiments, a catalyst with a mixture of Group VIII metals can be operated over a wider range of temperatures while still providing sufficient desulfurization to meet naphtha and/or diesel sulfur specifications. This can allow for creation of a wider range of naphtha versus diesel product ratios at temperatures that produce a commercially viable run length for the catalyst.

One conventional process for gasoline production can be to convert a higher boiling feed into a naphtha-boiling range product. For example, a relatively low-grade distillate feed, such as a light cycle oil from a fluid catalytic cracking unit, can be hydrocracked to gasoline at relatively high conversion with some internal recycle of unconverted product. Instead of recycling the entire unconverted product, a portion of the unconverted product can be withdrawn as an unconverted product, such as a diesel product. This withdrawn unconverted product can advantageously have improved properties relative to the feed. For example, the sulfur content of the unconverted product can be improved, such that the sulfur content renders the unconverted product suitable for use as ultra low sulfur (e.g., 10 wppm or less) diesel.

By operating a light feed hydrocracker reaction system to have less than 100% conversion of feed to naphtha boiling range products, the reaction system can be used to make a portion of this improved unconverted product. Operating the light feed hydrocracker reaction system to produce an unconverted product in addition to a converted product can provide flexibility for refineries to match products with changes in demand. However, increasing the amount of unconverted product often corresponds to reducing the total reactivity of the system, such as by reducing the temperature and/or increasing the space velocity. With conventional catalysts, decreasing the total reactivity can lead to insufficient desulfurization of the feed. Thus, although additional unconverted product can be created, the additional unconverted product can tend to have a sulfur content greater than a desired amount for a diesel fuel.

In various embodiments, methods are provided for producing a converted product and an unconverted product. The converted product and unconverted product can be defined relative to a conversion temperature. An at least partially distillate boiling range feed can be exposed to hydrocracking conditions in a first hydrocracking stage. The effluent from the first stage can then be passed through a separator to separate a gas phase portion of the effluent from a liquid phase portion. The liquid effluent can then be fractionated to produce at least a converted fraction and an unconverted fraction. A portion of the unconverted fraction can be withdrawn as an unconverted product. The remaining portion of the unconverted fraction can then be exposed to hydrocracking conditions in a second hydrocracking stage. The effluent from the second hydrocracking stage can be separated to remove a gas phase portion. The remaining liquid effluent from the second hydrocracking stage can be fed to the same (or a different) fractionator. Optionally, the liquid effluent from the first stage and the second stage can be combined prior to entering the fractionator. Optionally, a dewaxing catalyst can be included within a reactor to further improve the cold flow properties of the unconverted product.

The above provides the general process flow for a feed through the system. By using a catalyst according to the invention, additional flexibility in processing of feeds can be achieved. For example, when processing a single feed and/or different feeds, the temperature can be varied to produce varying amounts of unconverted product while still meeting desired sulfur specifications.

Feedstock

A mineral hydrocarbon feedstock refers to a hydrocarbon feedstock derived from the earth (e.g., crude oil, oil shale, etc.) that has optionally been subjected to one or more separation and/or other refining processes. The mineral hydrocarbon feedstock can be a petroleum feedstock boiling in the diesel range or above. Examples of suitable mineral feeds can include atmospheric gas oils, light cycle oils, or other feeds with a boiling range profile similar to an atmospheric gas oil and/or a light cycle oil. Other examples of suitable mineral feeds can include, but are not limited to, virgin distillates, hydrotreated virgin distillates, kerosene, diesel boiling range feeds (such as hydrotreated diesel boiling range feeds), and the like, and combinations thereof.

The boiling range of a suitable feedstock can be characterized in various manners. One option can be to characterize the amount of feedstock that boils above about 350° F. (177° C.). At least about 60 wt %, for example at least about 80 wt % or at least about 90 wt %, of a feedstock can boil above about 350° F. (about 177° C.). Additionally or alternately, at least about 60 wt %, for example at least about 80 wt % or at least about 90 wt %, of the feedstock can boil above about 400° F. (about 204° C.). Another option can be to characterize the amount of feed that boils below a temperature value. In addition to, or as an alternative to, the boiling range features described above, at least about 60 wt %, for example at least about 80 wt % or at least about 90 wt %, of a feedstock can boil below about 650° F. (about 343° C.). Further additionally or alternately, at least about 60 wt %, for example at least about 80 wt % or at least about 90 wt %, of a feedstock can boil below about 700° F. (about 371° C.). Still further additionally or alternatively, a feedstock can have a final boiling point of about 825° F. (about 441° C.) or less, for example about 800° F. (about 427° C.) or less, about 750° F. (about 399° C.) or less, or about 700° F. (about 371° C.) or less. Temperature values can be based on ASTM D2887.

In a preferred embodiment, the feedstock is comprised of a light cycle oil boiling range material (also referred to herein as "light cycle oil"). As defined herein, a light cycle oil is a hydrocarbon boiling with a T10 boiling point of at least 300° F. (119° C.) and a T90 boiling point less than or equal to 650° F. (343° C.). The terms "T10 boiling point" and "T90 boiling point" (and similar) are known terms in the industry. By the term "T10 boiling point" it is meant that 10 wt % of the material will be in the vapor phase at the defined temperature under standard conditions. Similarly, by the term "T90 boiling point" it is meant that 90 wt % of the material will be in the vapor phase at the defined temperature under standard conditions. Under a specifically preferred embodiment herein, feedstock (in particular either the first or second feedstock as further described herein) consists essentially of, or alternatively is, a light cycle oil boiling range material.

In some embodiments, a "sour" feed can be used. In such embodiments, the nitrogen content can be at least about 50 wppm, for example at least about 75 wpm or at least about 100 wppm. Even in such "sour" embodiments, the nitrogen content can optionally but preferably be about 2000 wppm or less, for example about 1500 wppm or less or about 1000 wppm or less. Additionally or alternately in such "sour" embodiments, the sulfur content can be at least about 100 wppm, for example at least about 200 wppm or at least about 500 wppm. Further additionally or alternately, even in such "sour" embodiments, the sulfur content can optionally but preferably be about 3.0 wt % or less, for example about 2.0 wt % or less or about 1.0 wt % or less.

In some embodiments, a "sweet" feed having a relatively lower level of sulfur and/or nitrogen contaminants may be used as at least a portion of the feed entering a reactor. A sweet feed can represent a hydrocarbon feedstock that has been hydrotreated and/or that otherwise has a relatively low sulfur and nitrogen content. For example, the input flow to the second stage of the hydrocracking reaction system can typically be a sweet feed. In such embodiments, the sulfur content can advantageously be about 100 wppm or less, for example about 50 wppm or less, about 20 wpm or less, or about 10 wppm or less. Additionally or alternately in such embodiments, the nitrogen content can be about 50 wppm or less, for example about 20 wppm or less or about 10 wppm or less.

In the discussion below, a biocomponent feedstock refers to a hydrocarbon feedstock derived from a biological raw material component, from biocomponent sources such as vegetable, animal, fish, and/or algae. Note that, for the purposes of this document, vegetable fats/oils refer generally to any plant based material, and can include fat/oils derived from a source such as plants of the genus *Jatropha*. Generally, the biocomponent sources can include vegetable fats/oils, animal fats/oils, fish oils, pyrolysis oils, and algae lipids/oils, as well as components of such materials, and in some embodiments can specifically include one or more type of lipid compounds. Lipid compounds are typically biological compounds that are insoluble in water, but soluble in nonpolar (or fat) solvents. Non-limiting examples of such solvents include alcohols, ethers, chloroform, alkyl acetates, benzene, and combinations thereof.

Major classes of lipids include, but are not necessarily limited to, fatty acids, glycerol-derived lipids (including fats, oils and phospholipids), sphingosine-derived lipids (including ceramides, cerebrosides, gangliosides, and sphingomyelins), steroids and their derivatives, terpenes and their derivatives, fat-soluble vitamins, certain aromatic compounds, and long-chain alcohols and waxes.

In living organisms, lipids generally serve as the basis for cell membranes and as a form of fuel storage. Lipids can also be found conjugated with proteins or carbohydrates, such as in the form of lipoproteins and lipopolysaccharides.

Examples of vegetable oils that can be used in accordance with this invention include, but are not limited to rapeseed (canola) oil, soybean oil, coconut oil, sunflower oil, palm oil, palm kernel oil, peanut oil, linseed oil, tall oil, corn oil, castor oil, jatropha oil, jojoba oil, olive oil, flaxseed oil, camelina oil, safflower oil, babassu oil, tallow oil, and rice bran oil.

Vegetable oils as referred to herein can also include processed vegetable oil material. Non-limiting examples of processed vegetable oil material include fatty acids and fatty acid alkyl esters. Alkyl esters typically include $C_1$-$C_5$ alkyl esters. One or more of methyl, ethyl, and propyl esters are preferred.

Examples of animal fats that can be used in accordance with the invention include, but are not limited to, beef fat (tallow), hog fat (lard), turkey fat, fish fat/oil, and chicken fat. The animal fats can be obtained from any suitable source including restaurants and meat production facilities.

Animal fats as referred to herein also include processed animal fat material. Non-limiting examples of processed animal fat material include fatty acids and fatty acid alkyl esters. Alkyl esters typically include $C_1$-$C_5$ alkyl esters. One or more of methyl, ethyl, and propyl esters arc preferred.

Algae oils or lipids are typically contained in algae in the form of membrane components, storage products, and metabolites. Certain algal strains, particularly microalgae such as diatoms and cyanobacteria, contain proportionally high levels of lipids. Algal sources for the algae oils can contain varying amounts, e.g., from 2 wt % to 40 wt % of lipids, based on total weight of the biomass itself.

Algal sources for algae oils include, but are not limited to, unicellular and Es multicellular algae. Examples of such algae include a rhodophyte, chlorophyte, heterokontophyte, tribophyte, glaucophyte, chlorarachniophyte, euglenoid, haptophyte, cryptomonad, dinoflagellum, phytoplankton, and the like, and combinations thereof. In one embodiment, algae can be of the classes Chlorophyceae and/or Haptophyta. Specific species can include, but are not limited to, *Neochloris oleoabundans, Scenedesmus dimorphus, Euglena gracilis, Phaeodactylum tricornutum, Pleurochysis carterae, Prymnesium parvum, Tetraselmis chui*, and *Chlamydomonas reinhardii.*

Additionally or alternately, non-limiting examples of microalgae can include, for example, *Achnanthes, Amphiprora, Amphora, Ankistrodesmus, Asteromonas, Boekelovia, Borodinella, Botryococcus, Bracteococcus, Chaetoceros, Carteria, Chlamydomonas, Chlorococcum, Chlorogonium, Chlorella, Chroomonas, Chrysosphaera, Cricosphaera, Crypthecodinium, Cryptomonas, Cyclotella, Dunaliella, Ellipsoidon, Emiliania, Eremosphaera, Ernodesmius, Euglena, Franceia, Fragilaria, Gloeothamnion, Haematococcus, Halocafeteria, Hymenomonas, Isochrysis, Lepocinclis, Micractinium, Monoraphidium, Nannochloris, Nannochloropsis, Navicula, Neochloris, Nephrochioris, Nephroselmis, Nitzschia, Ochromonas, Oedogonium, Oocystis, Ostreococcus, Pavlova, Parachlorella, Pascheria, Phaeodactylum, Phagus, Platymonas, Pleurochrysis, Pleurococcus, Prototheca, Pseudochlorella, Pyramimonas, Pyrobotrys, Scenedesmus, Skeletonema, Spyrogyra, Stichococcus, Tetraselmis, Thalassiosira, Viridiella*, and *Volvox* species, including freshwater and marine microalgal species of these or other genera.

Further additionally or alternately, the algae used according to the invention can be characterized as cyanobacteria, Non-limiting examples of cyanobacteria can include, for example, *Agmenellum, Anabaena, Anabaenopsis, Anacystis, Aphanizomenon, Arthrospira, Asterocapsa, Borzia, Calothrix, Chamoesiphon, Chlorogloeopsis, Chrooeoccidiopsis, Chroococcus, Crinalium, Cyanobacterium, Cyanobium,*

*Cyanocystis, Cyanospira, Cyanothece, Cylindrospermopsis, Cylindrospermum, Dactylococcopsis, Dermocarpella, Fischerella, Fremyella, Geitleria, Geitlerinema, Gloeobacter, Gloeocapsa, Gloeothece, Halospirulina, Iyengariella, Leptolyngbya, Limnothrix, Lyngbya, Microcoleus, Microcystis, Myxosarcina, Nodularia, Nostoc, Nostochopsis, Osciliatoria, Phormidium, Planktothrix, Pleurocapsa, Prochlorococcus, Prochloron, Prochlorothrix, Pseudanabaena, Rivuluria, Schizothrix, Scytonema, Spirulina, Stanieria, Starria, Stigonema, Symploca, Synechococcus, Synechocystis, Tolypothrix, Trichodesmium, Tychonema*, and *Xenococcus* species, including freshwater and marine cyanobacterial species of these or other genera.

The biocomponent feeds usable in the present invention can include any of those which comprise primarily triglycerides and free fatty acids (FFAs). The triglycerides and FFAs typically contain aliphatic hydrocarbon chains in their structure having from 8 to 36 carbons, preferably from 10 to 26 carbons, for example from 14 to 22 carbons. Types of triglycerides can be determined according to their fatty acid constituents. The fatty acid constituents can be readily determined using Gas Chromatography (GC) analysis. This analysis involves extracting the fat or oil, saponifying (hydrolyzing) the fat or oil, preparing an alkyl (e.g., methyl) ester of the saponified fat or oil, and determining the type of (methyl) ester using GC analysis. In one embodiment, a majority (i.e., greater than 50%) of the triglyceride present in the lipid material can be comprised of $C_{10}$ to $C_{26}$, for example $C_{12}$ to $C_{is}$, fatty acid constituents, based on total triglyceride present in the lipid material. Further, a triglyceride is a molecule having a structure substantially identical to the reaction product of glycerol and three fatty acids. Thus, although a triglyceride is described herein as being comprised of fatty acids, it should be understood that the fatty acid component does not necessarily contain a carboxylic acid hydrogen. Other types of feed that are derived from biological raw material components can include fatty acid esters, such as fatty acid alkyl esters (e.g., FAME and/or FAEE).

Biocomponent based diesel boiling range feedstreams typically have relatively low nitrogen and sulfur contents. For example, a biocomponent based feedstream can contain a nitrogen content up to about 500 wppm, for example up to about 300 wppm or up to about 100 wppm, and/or a sulfur content up to about 500 wppm, for example up to about 300 wppm or up to about 100 wppm. Instead of nitrogen and/or sulfur, the primary heteroatom component in biocomponent feeds is typically oxygen. Biocomponent diesel boiling range feedstreams, e.g., can include an oxygen content up to about 10 wt %, for example up to about 12 wt % or up to about 14 wt %. Suitable biocomponent diesel boiling range feedstreams, prior to hydrotreatment, can include an oxygen content of at least about 1 wt %, for example at least about 2 wt %, at least about 3 wt %, at least about 5 wt %, or at least about 8 wt %.

In an embodiment, the feedstock can include up to about 100% of a feed having a biocomponent origin, which can include or be a hydrotreated vegetable oil feed, hydrotreated fatty acid alkyl ester feed, or another type of hydrotreated biocomponent feed. A hydrotreated biocomponent feed can be a biocomponent feed that has been previously hydroprocessed, e.g., to reduce the oxygen content of the feed to about 500 wppm or less, for example to about 200 wppm or less or to about 100 wppm or less. Correspondingly, a biocomponent feed can be hydrotreated, e.g., to reduce the oxygen content of the feed, prior to other optional hydroprocessing, to about 500 wppm or less, for example to about 200 wppm or less or to about 100 wppm or less. Additionally or alternately, a biocomponent feed can be blended with a mineral feed, so that the blended feed can be tailored to have an oxygen content of about 500 wppm or less, for example about 200 wppm or less or about 100 wppm or less, optionally in addition to feed targets for nitrogen and/or sulfur content, as noted below. In embodiments where at least a portion of the feed is of a biocomponent origin, that portion can be at least about 2 wt %, for example at least about 5 wt %, at least about 10 wt %, at least about 20 wt %, at least about 25 wt %, at least about 35 wt %, at least about 50 wt %, at least about 60 wt %, or at least about 75 wt %. Additionally or alternately, where at least a portion of the feed is of a biocomponent origin, the biocomponent portion can be about 75 wt % or less, for example about 60 wt % or less, about 50 wt % or less. about 35 wt % or less, about 25 wt % or less, about 20 wt % or less, about 10 wt % or less, or about 5 wt % or less.

In embodiments where the feed is a mixture of a mineral feed and a biocomponent feed, the mixed feed can exhibit a sulfur content of about 5000 wppm or less, for example about 2500 wppm or less. about 1000 wppm or less, about 500 wppm or less, about 200 wppm or less, about 100 wppm or less, about 50 wppm or less, about 30 wppm or less, about 20 wppm or less, about 15 wppm or less, or about 10 wppm or less. In certain optional embodiments, the mixed feed can exhibit a sulfur content of at least about 100 wppm, for example at least about 200 wppm or at least about 500 wppm. Additionally or alternately, in embodiments where the feed is a mixture of a mineral feed and a biocomponent feed, the mixed feed can exhibit a nitrogen content of about 2000 wppm or less, for example about 1500 wppm or less, about 1000 wppm or less, about 500 wppm or less, about 200 wppm or less, about 100 wppm or less, about 50 wppm or less, about 30 wppm or less, about 20 wppm or less, about 15 wppm or less, or about 10 wppm or less.

In some embodiments, a dewaxing catalyst can be used that includes the sulfide form of a metal, such as a dewaxing catalyst that includes nickel and tungsten. In such embodiments, it can be beneficial for the feed to have at least a minimum sulfur content. The minimum sulfur content can be sufficient to maintain the sulfided metals of the dewaxing catalyst in a sulfided state. In such embodiments, for example, the feedstock encountered by the dewaxing catalyst (Which can be partially processed) can have a sulfur content of at least about 100 wppm. for example at least about 150 wppm or at least about 200 wppm. Additionally or alternately in such embodiments, the feedstock can have a sulfur content of about 500 wppm or less, or about 400 wppm or less, or about 300 wppm or less. In combination with, or regardless of, the sulfur content of the feedstock, additional sulfur can be provided to maintain the metals of a dewaxing catalyst in a sulfide state, e.g., by introducing gas phase sulfur such as $H_2S$. One potential source of $H_2S$ gas can be from hydrotreatment of the mineral portion of a feed. If a mineral feed portion is hydrotreated prior to combination with a biocomponent feed, a portion of the gas phase effluent from the hydrotreatment process or stage can be cascaded along with hydrotreated liquid effluent to provide the gas phase sulfur contribution.

The contents of contents of components such as sulfur, nitrogen, oxygen, and olefins (inter alia) in a feedstock created by blending two or more feedstocks can typically be determined using a weighted average based on the blended feeds. For example, a mineral feed and a biocomponent feed can be blended in a ratio of about 80 wt % mineral feed and about 20 wt % biocomponent feed. In such a scenario, if the mineral feed has a sulfur content of about 1000 wppm, and the biocomponent feed has a sulfur content of about 10 wppm, the resulting blended feed could be expected to have a sulfur content of about 802 wppm.

In an embodiment, a distillate boiling range feedstream suitable for use as a hydrocracker feed can have a cloud point of at least about 6° F. (about −14° C.), for example at least about 12° F. (about −11° C.) or at least about 18° F. (about −7° C.). Additionally or alternately, the distillate boiling range feedstream can have a cloud point of about 42° F. (about 6° C.) or less, preferably about 30° F. (about −1° C.) or less, for example about 24° F. (about −4° C.) or less, or about 15° F. (about −9° C.) or less. Further additionally or alternately, the cetane number for the feed can be about 35 or less, for example about 30 or less. Still further additionally or alternately, the cetane number for the feed can be a cetane number typically observed for a feed such as a light cycle oil.

Reactor Configuration

In various embodiments, a reactor configuration can be used that is suitable for performing light feed hydrocracking to generate fuel products. The reaction system can be operated so that at least a majority (>50%) of the products from the light feed hydrocracking are converted products, such as naphtha boiling range products.

A reaction system suitable for performing the inventive method can include at least two hydrocracking stages. Note that a reaction stage can include one or more beds and/or one or more reactors. The first hydrocracking stage can optionally include two or more reactors, with the total effluent passed into each reactor in a stage. In an embodiment with two or more reactors in the first stage, a first reactor in the first stage can include one or more catalyst beds that contain hydrotreating catalyst. This can allow for heteroatom removal (hydrodesulfurization, hydrodenitrogenation, and/or hydrodeoxygenation) involving a feedstock. A second reactor in the first stage can contain one or more catalyst beds of hydrocracking catalyst. Having two or more reactors can allow for additional flexibility in selecting reaction conditions between the reactors. Various alternative configurations can be used for the first stage. For example, the first stage can include beds of both hydrotreating and hydrocracking catalyst in a single reactor. Another option can be to have multiple reactors, with at least one reactor that contains both hydrotreating and hydrocracking catalyst.

Optionally, in addition to the hydrocracking and optional hydrotreating catalyst, at least one bed of catalyst in the first stage can include a catalyst capable of dewaxing. Optionally but preferably, the dewaxing catalyst can be placed in a bed that is downstream from at least a portion of the hydrocracking catalyst in the stage, such as by placing the dewaxing catalyst in a final catalyst bed in the stage. Other options for the location of dewaxing catalyst can be: to place the dewaxing catalyst after all of the hydrocracking catalyst; to place the dewaxing catalyst after at least one bed of hydrocracking catalyst; or to place the dewaxing catalyst before the first bed of the hydrocracking catalyst. Placing the dewaxing catalyst in the final bed of the stage can allow the dewaxing to occur on the products of the hydrocracking reaction, which advantageously can allow for dewaxing of any paraffinic species created due to ring-opening during the hydrocracking reactions. Furthermore, having the dewaxing catalyst in a separate bed from the hydrocracking catalyst can allow for some additional control of reaction conditions during catalytic dewaxing, such as allowing for some separate temperature control of the dewaxing and hydrocracking processes. Locating the dewaxing catalyst in the first stage can allow the dewaxing to be performed on the total feedstock/effluent in the stage.

One option for achieving additional control of the dewaxing reaction conditions can be to include a quench between the hydrocracking catalyst bed(s) and the dewaxing catalyst bed(s). Because hydroprocessing reactions are typically exothermic, using a quench stream between beds of hydroprocessing catalyst can provide some temperature control to allow for selection of dewaxing conditions. For example, an optional gas quench, such as a hydrogen gas quench and/or an inert gas quench, can be included between the hydrocracking beds and the dewaxing bed. If hydrogen is introduced as part of the quench, the quench hydrogen can also modify the amount of available hydrogen for the dewaxing reactions.

A separation device can be used after the first stage to remove gas phase contaminants in the first stage effluent generated during exposure of the feedstock to the hydrocracking, dewaxing, and/or hydrotreating catalysts. The separation device can produce a gas phase output and a liquid phase output. The gas phase output can be treated in a typical manner for a contaminant gas phase output, such as scrubbing the gas phase output to allow for recycling of any hydrogen content.

The liquid phase output from the separator can then be fractionated to form at least a converted fraction and an unconverted fraction. For example, the fractionator can be used to produce at least a naphtha fraction and a diesel fraction. Additional fractions can also be produced, such as a heavy naphtha fraction (in which case the naphtha fraction would effectively constitute a light naphtha fraction). Any naphtha fractions from the fractionator can be sent to the gasoline pool, or one or more of the naphtha fractions can undergo further processing, for example to improve the octane rating, before being sent to the gasoline pool. This could include using a naphtha fraction as a feed to a reforming unit.

At least a portion of the unconverted fraction can be withdrawn as a product stream. The remainder of the unconverted fraction, if any, can be used as an input for a second hydrocracking stage. Relative to the first stage, the second hydrocracking stage can have a lower level of sulfur and nitrogen contaminants. The hydrocracking conditions in the second stage can be selected to achieve a total desired level of conversion. Optionally, a dewaxing catalyst can be included in the second stage in addition to and/or in place of the dewaxing catalyst in the first stage.

Optionally, the second stage effluent can be passed into a gas-liquid separation device that may be the same as or different from the first stage separator. The gas phase portion from the separation device can be recycled to recapture hydrogen, or can be used in any convenient manner. The liquid phase portion can be fed to the fractionator. In common fractionator embodiments, the liquid phase portion can be combined with the liquid effluent from the first stage prior to entry into the fractionator, or the two liquid effluent streams can enter the fractionator at separate locations. Alternately, separate fractionators can be used to process some or all of the first stage effluent and the second stage effluent.

In an optional embodiment, a preliminary stage can be included prior to the first stage. In this type of embodiment, a preliminary stage reactor (or reactors) can be used to perform hydrotreatment of a feedstock. The preliminary stage reactor (s) can optionally include hydrocracking catalyst as well. A gas-liquid separation device can be used after the preliminary stage reactor(s) to separate gas phase products (which can be the same as or different than either or both of the first and second stage separator(s)). The liquid effluent from the preliminary stage reactor(s) can then pass into the one or more first stage reactors, e.g., that include hydrocracking catalyst.

As described above, the one or more first stage reactors can also optionally include some hydrotreating catalyst. An embodiment involving a preliminary stage can be useful, for example, if the feedstock includes a biocomponent portion that could benefit from pretreatment. In such a situation, is the preliminary stage reactor(s) can be operated to perform a mild hydrotreatment that is sufficient for at least partial hydrodeoxygenation of the feed, as well as some optional hydrodesulfurization and/or hydrodenitrogenation, as necessary. The hydrodeoxygenation reaction can produce CO and $CO_2$ as contaminant by-products. In addition to being potential catalyst poisons, any CO generated may be difficult to handle if it is passed into the general refinery hydrogen recycle system. Using a preliminary hydrotreatment stage can allow CO and $CO_2$ to be removed in the preliminary stage separation device. The gas phase effluent from the preliminary stage separation device can then receive different handling from a typical gas phase effluent. For example, it may be cost effective to use the gas phase effluent from a preliminary stage separator as fuel gas, as opposed to attempting to scrub the gas phase effluent and recycle the hydrogen.

Catalyst and Reaction Conditions

In various embodiments, the reaction conditions in the reaction system can be selected to generate a desired level of conversion of a feed. Conversion of the feed can be defined in terms of conversion of molecules that boil above a temperature threshold to molecules below that threshold. For example, in a light feed hydrocracker, the conversion temperature can be about 350° F. (about 177° C.), inter alia, (alternately, e.g., about 375° F. (about 191° C.), about 400° F. (about 204° C.), or about 425° F. (about 218° C.). Optionally, the conversion temperature can be indicative of a desired cut point for a converted fraction product generated by the light feed hydrocracker reaction system. Alternately, the conversion temperature can be a convenient temperature for characterizing the products, with cut points selected at other temperatures.

The amount of conversion of a feedstock can be characterized at several locations within a reaction system. One potential characterization for the conversion of feedstock can be the amount of conversion in the first reaction stage. As described above, this conversion temperature can be any convenient temperature, such as about 350° F. (about 17° C.), about 375° F. (about 191° C.), about 400° F. (about 204° C.), or about 425° F. (about 218° C.). In an embodiment, the amount of conversion in the first stage can be at least about 40%, for example at least about 50%. Additionally or alternately, the amount of conversion in the first stage can be about 75% or less, for example about 65% or less or about 60% or less. Another way to characterize the amount of conversion can be to characterize the amount of conversion in the total liquid products generated by the reaction system. This can include any naphtha, diesel, or other product streams that exit the reaction system. This conversion amount includes conversion that occurs in any stage of the reaction system. In an embodiment, the amount of conversion for the reaction system can be at least about 50%, for example at least about 60%, at least about 70%, or at least about 80%. Additionally or alternately, the amount of conversion for the reaction system can be about 95% or less, for example about 90% or less, about 85% or less, about 75% or less, or about 70% or less.

Hydrocracking catalysts typically contain sulfided base metals on acidic supports, such as amorphous silica-alumina, cracking zeolites such as USY, and/or acidified alumina. Often these acidic supports are mixed or bound with other metal oxides such as alumina, titania, and/or silica. The acidic support can be the primary source of cracking activity for a catalyst. Typically, as the temperature increases, the amount of cracking can increase for a given acidic support. Support materials which may be used can comprise a refractory oxide material such as alumina, silica, alumina-silica, kieselguhr, diatomaceous earth, magnesia, zirconia, or combinations thereof, with alumina, silica, alumina-silica being the most common (and preferred, in one embodiment).

In various embodiments, the sulfided base metals can include nickel and a combination of molybdenum and tungsten. The molar ratio of Group VIII to Group VIB metals can be from about 9:1 to about 1:9, for example from about 3:1 to about 1:3 or from about 2:1 to about 1:2. As noted above, the molar ratio of molybdenum to tungsten can have a value from about 3:1 to about 1:3. The combination of nickel, molybdenum, and tungsten can provide a substantial portion of the desulfurization activity of the catalyst. This desulfurization activity can increase as the molar ratio of molybdenum to tungsten approaches 1:1.

In various embodiments, hydrocracking conditions in the first stage and the second stage can be selected (together or independently) to achieve a desired level of conversion in the reaction system. A hydrocracking process in the first stage (or otherwise under sour conditions) can be carried out using one or more of the following conditions: a temperature from about 550° F. (about 288° C.) to about 750° F. (about 399° C.), a hydrogen partial pressure from about 250 psig (about 1.7 MPag) to about 5000 psig (about 34.5 MPag), a liquid hourly space velocity from about 0.05 $hr^{-1}$ to about 10 $hr^{-1}$, and a hydrogen treat gas rate from about 200 scf/bbl (about 34 $Nm^3/m^3$) to about 10,000 scf/bbl (about 1781 $Nm^3/m^3$). Additionally or alternately, the conditions can include one or more of a temperature from about 600° F. (about 343° C.) to about 710° F. (about 377° C.), a hydrogen partial pressure from about 500 psig (about 3.5 MPag) to about 3000 psig (about 20.7 MPag), a liquid hourly space velocity from about 0.2 $hr^{-1}$ to about 2 $hr^{-1}$, and a hydrogen treat gas rate from about 1200 scf/bbl (about 200 $Nm^3/m^{-3}$) to about 6000 scf/bbl (about 1020 $Nm^3/m^3$). In a preferred embodiment, first hydrocracking conditions at start-of-run have a temperature of less than about 710° F. (377° C.).

A hydrocracking process in a second stage (or otherwise under non-sour, or sweet, conditions) can be performed under conditions similar to those used for a first stage hydrocracking process, or the conditions can be different. In an embodiment, the conditions in a (non-sour or sweet) second stage can have less severe conditions than a hydrocracking process in a first (sour) stage. In such an embodiment, the second stage hydrocracking process conditions can include a temperature about 20° F. (11° C.), or even about 40° F. (22° C.), less than the temperature for a hydrocracking process in the first stage, for example about 80° F. (about 44° C.) less or about 120° F. (about 67° C.) less, and/or a pressure about 100 psig (690 kPag) less than the pressure for a hydrocracking process in the first stage, for example about 200 psig (about 1.4 MPag) less or about 300 psig (about 2.1 MPag) less. Additionally or alternately, suitable hydrocracking conditions for a second (non-sour, or sweet) stage can include, but are not limited to, conditions similar to a first (sour) stage, which can include one or more of the following conditions: a temperature from about 550° F. (about 288° C.) to about 750° F. (about 399° C.), a hydrogen partial pressure from about 250 psig (about 1.7 MPag) to about 5000 psig (about 34.5 MPag), a liquid hourly space velocity from about 0.05 $hr^{-1}$ to about 10 $hr^{-1}$, and a hydrogen treat gas rate from about 200 scf/bbl (about 34 $Nm^3/m^3$) to about 10,000 scf/bbl (about 1781 $Nm^3/m^3$). Additionally or alternately, the conditions can include one or more of a temperature from about 600° F. (about 343° C.) to about 815° F. (about 435° C.), a hydrogen partial pressure from about 500 psig (about 3.5 MPag) to about 3000 psig (about 20.7 MPag), a liquid hourly space velocity from about 0.2 $hr^{-1}$ to about 2 $hr^{-1}$, and a hydrogen treat gas rate from about 1200 scf/bbl (about 200 $Nm^3/m^3$) to about 6000 scf/bbl (about 1020 $Nm^3/m^3$).

In various embodiments, the hydrocracking catalyst for the second stage can be the same or different from the catalyst in the first stage. Hydrocracking catalysts typically contain sulfided base metals on acidic supports, such as amorphous silica-alumina, cracking zeolites such as USY, and/or acidified alumina. Often these acidic supports are mixed or bound with other metal oxides such as alumina, titania, and/or silica. Non-limiting examples of metals for hydrocracking catalysts include nickel, nickel-cobalt-molybdenum, cobalt-molybdenum, nickel-tungsten, nickel-molybdenum, and/or nickel-molybdenum-tungsten. Additionally or alternately, hydrocracking catalysts with noble metals can also be used. Non-limiting examples of noble metal catalysts include those based on platinum and/or palladium. Support materials which may be used can comprise a refractory oxide material such as alumina, silica, alumina-silica, kieselguhr, diatomaceous earth, magnesia, zirconia, or combinations thereof, with alumina, silica., alumina-silica being the most common (and preferred. in one embodiment).

In various embodiments, a feed can also be hydrotreated in the first stage and/or in a preliminary stage prior to further processing. A suitable catalyst for hydrotreatment can comprise, consist essentially of, or be a catalyst composed of one or more Group VIII and/or Group VIB metals, optionally on a support, such as a metal oxide support. Suitable metal oxide supports can include relatively low acidic oxides such as silica., alumina, silica-aluminas, titania, or a combination thereof. The supported Group VIII and/or Group VIB metal (s) can include, but are not limited to, Co, Ni, Fe, Mo, W, Pt, Pd, Rh, Ir, and combinations thereof. individual hydrogenation metal embodiments can include, but are not limited to, Pt only, Pd only, or Ni only, while mixed hydrogenation to metal embodiments can include, but are not limited to, Pt and Pd, Pt and Rh, Ni and W, Ni and Mo, Ni and Mo and W, Co and Mo, Co and Ni and Mo, Co and Ni and W, or another combination. When only one hydrogenation metal is present, the amount of that hydrogenation metal can be at least about 0.1 wt % based on the total weight of the catalyst, for example at least about 0.5 wt % or at least about 0.6 wt %. Additionally or alternately when only one hydrogenation metal is present, the amount of that hydrogenation metal can be about 5.0 wt % or less based on the total weight of the catalyst, for example about 3.5 wt % or less, about 2.5 wt % or less, about 1.5 wt % or less, about 1.0 wt % or less, about 0.9 wt % or less, about 0.75 wt % or less, or about 0.6 wt % or less. Further additionally or alternately when more than one hydrogenation metal is present, the collective amount of hydrogenation metals can be at least about 0.1 wt % based on the total weight of the catalyst, for example at least about 0.25 wt %, at least about 0.5 wt %, at least about 0.6 wt %, at least about 0.75 wt %, or at least about i wt %. Still further additionally or alternately when more than one hydrogenation metal is present, the collective amount of hydrogenation metals can be about 35 wt % or less based on the total weight of the catalyst, for example about 30 wt % or less, about 25 wt % or less, about 20 wt % or less, about 15 wt % or less, about 10 wt % or less, or about 5 wt % or less. In embodiments wherein the supported metal comprises a noble metal, the amount of noble metal(s) is typically less than about 2 wt %, for example less than about 1 wt %, about 0.9 wt % or less, about 0.75 wt % or less, or about 0.6 wt % or less. The amounts of metal(s) may be measured by methods specified by ASTM for individual metals, including but not limited to atomic absorption spectroscopy (AAS), inductively coupled plasma-atomic emission spectrometry (ICP-AAS), or the like.

Hydrotreating conditions can typically include one or more of the following conditions: a temperature from about 550° F. (about 288° C.) to about 830° F. (about 443° C.), a hydrogen partial pressure from about 250 psig (about 1.7 MPag) to about 5000 psig (about 34.5 MPag), a liquid hourly space velocity from about 0.05 $hr^{-1}$ to about 10 $hr^{-1}$, and a hydrogen treat gas rate from about 200 scf/bbl (about 34 $Nm^3/m^3$) to about 10,000 scf/bbl (about 1781 $Nm^3/m^3$). Additionally or alternately, the conditions can include one or more of a temperature from about 600° F. (about 343° C.) to about 750° F. (about 399° C.), a hydrogen partial pressure from about 500 psig (about 3.5 MPag) to about 3000 psig (about 20.7 MPag), a liquid hourly space velocity from about 0.2 $hr^{-1}$ to about 2 $hr^{-1}$, and a hydrogen treat gas rate from about 1200 scf/bbl (about 200 $Nm^3/m^3$) to about 6000 scf/bbl (about 1020 $Nm^3/m^3$). The different ranges of temperatures can be used based on the type of feed and the desired hydrotreatment result. For example, the temperature range of about 550° F. (about 288° C.) to about 650° F. (about 343° C.) could be suitable for a mild hydrotreatment process for deoxygenation of a feed containing a biocomponent portion.

In still another embodiment, the same conditions can be used for hydrotreating and hydrocracking beds or stages, such as using hydrotreating conditions for both or using hydrocracking conditions for both. Additionally or alternately, the pressure for the hydrotreating and hydrocracking beds or stages can be the same.

In some alternative or optional embodiments, a dewaxing catalyst can also be included in the first stage, the second stage, and/or other stages in the light feed hydrocracker. Typically, the dewaxing catalyst can be located in a bed downstream from any hydrocracking catalyst present in a stage. This can allow the dewaxing to occur on molecules that have already been hydrotreated to remove a significant fraction of organic sulfur- and nitrogen-containing species. Optionally, the dewaxing catalyst can be located in the same reactor as at least a portion of the hydrocracking catalyst in a stage. Alternately, the entire effluent from a reactor containing hydrocracking catalyst can be fed into a separate reactor containing the dewaxing catalyst. Exposing the dewaxing catalyst to the entire effluent from prior hydrocracking can expose the catalyst to a hydrocarbon stream that includes both a converted fraction and an unconverted fraction. In some embodiments, exposing the dewaxing catalyst to this type of hydrocarbon stream can provide unexpected benefits. For example, using the entire hydrocarbon stream instead of just the unconverted fraction can decrease the temperature required to achieve a desired drop in cloud point for the unconverted fraction of the hydrocarbon stream. This decrease in temperature can be accompanied by an increase in space velocity for the feed over the dewaxing catalyst, such as an increase in space velocity sufficient so that at least as much unconverted fraction is dewaxed, as compared to a configuration where only the unconverted fraction is dewaxed.

Suitable dewaxing catalysts can include, but are not limited to, molecular to sieves such as crystalline aluminosilicates (zeolites). in an embodiment, the molecular sieve can comprise, consist essentially of, or be ZSM-5, ZSM-22, ZSM-23, ZSM-35, ZSM-48, zeolite Beta, or a combination thereof, for example ZSM-23, zeolite Beta, and/or ZSM-48. Optionally but preferably, molecular sieves that are selective for dewaxing by isomerization as opposed to cracking can be used, such as ZSM-48, zeolite Beta, ZSM-23, or a combination thereof.

Additionally or alternately, the molecular sieve can comprise, consist essentially of, or be a 10-member ring 1-D molecular sieve. Optionally but preferably, the dewaxing catalyst can include a binder for the molecular sieve, such as alumina, titania, silica, silica-alumina, zirconia, or a combination thereof, for example alumina and titania or two or more of silica, zirconia, and titania.

One characteristic that can impact the activity of the molecular sieve is the ratio of silica to alumina ($Si/Al_2$ ratio) in the molecular sieve. In an embodiment, the molecular sieve can have a silica to alumina ratio of about 200:1 or less, for example about 150:1 or less, about 120:1 or less, about 100:1 or less, about 90:1 or less, or about 75:1 or less. Additionally or alternately, the molecular sieve can have a silica to alumina ratio of at least about 30:1, for example at least about 40:1, at least about 50:1, or at least about 65:1.

Aside from the molecular sieve(s) and optional binder, the dewaxing catalyst can also optionally but preferably include at least one metal hydrogenation component, such as a Group VIII metal. Suitable Group VIII metals can include, but are not limited to, Pt, Pd, Ni, or a combination thereof. When a metal hydrogenation component is present, the dewaxing catalyst can include at least about 0.1 wt % of the Group VIII metal, for example at least about 0.3 wt %, at least about 0.5 wt %, at least about 1.0 wt %, at least about 2.5 wt %, or at least about 5.0 wt %. Additionally or alternately, the dewaxing catalyst can include about 10 wt % or less of the Group VIII metal, for example about 5.0 wt % or less, about 2.5 wt % or less, about 1.5 wt % or less, or about 1.0 wt % or less.

In some embodiments, the dewaxing catalyst can include an additional Group VIB metal hydrogenation component, such as W and/or Mo. In such embodiments, when a Group VIB metal is present, the dewaxing catalyst can include at least about 0.5 wt % of the Group VIB metal, for example at least about 1.0 wt %, at least about 2.5 wt %, or at least about 5.0 wt %. Additionally or alternately in such embodiments, the dewaxing catalyst can include about 20 wt % or less of the Group VIB metal, for example about 15 wt % or less, about 10 wt % or less, about 5.0 wt % or less, about 2.5 wt % or less, or about 1.0 wt % or less. In one preferred embodiment, the dewaxing catalyst can include Pt and/or Pd as the hydrogenation metal component. In another preferred embodiment, the dewaxing catalyst can include as the hydrogenation metal components Ni and W, Ni and Mo, or Ni and a combination of W and Mo.

In various embodiments, the dewaxing catalyst used according to the invention can advantageously be tolerant of the presence of sulfur and/or nitrogen during processing. Suitable catalysts can include those based on ZSM-48, ZSM-23, and/or zeolite Beta. It is also noted that ZSM-23 with a silica to alumina ratio between about 20:1 and about 40:1 is sometimes referred to as SSZ-32. Additional or alternate suitable catalyst bases can include 1-dimensional 10-member ring zeolites. Further additional or alternate suitable catalysts can include EU-2, EU-11, and/or ZBM-30.

A bound dewaxing catalyst can also be characterized by comparing the micropore (or zeolite) surface area of the catalyst with the total surface area. of the catalyst. These surface areas can be calculated based on analysis of nitrogen porosimetry data using the BET method for surface area measurement. Previous work has shown that the amount of zeolite content versus binder content in catalyst can be determined from BET measurements (see, e.g., Johnson, M. F. L., *Jour. Catal.*, (1978) 52, 425). The micropore surface area of a catalyst refers to the amount of catalyst surface area provided due to the molecular sieve and/or the pores in the catalyst in the BET measurements. The total surface area represents the micropore surface plus the external surface area of the bound catalyst. In one embodiment, the percentage of micropore surface area relative to the total surface area of a bound catalyst can be at least about 35%, for example at least about 38%, at least about 40%, or at least about 45%. Additionally or alternately, the percentage of micropore surface area relative to total surface area can be about 65% or less, for example about 60% or less, about 55% or less, or about 50% or less.

Additionally or alternately, the dewaxing catalyst can comprise, consist essentially of, or be a catalyst that has not been dealuminated. Further additionally or alternately, the binder for the catalyst can include a mixture of binder materials containing alumina.

Catalytic dewaxing can be performed by exposing a feedstock to a dewaxing catalyst under effective (catalytic) dewaxing conditions. Effective dewaxing conditions can include Hydrotreating conditions can typically include one or more of the following conditions: a temperature from about 550° F. (about 288° C.) to about 840° F. (about 449° C.), a hydrogen partial pressure from about 250 psig (about 1.7 MPag) to about 5000 psig (about 34.5 MPag), a liquid hourly space velocity from about 0.5 $hr^{-1}$ to about 20 $hr^{-1}$, and a hydrogen treat gas rate from about 200 scf/bbl (about 34 $Nm^3/m^3$) to about 10,000 scf/bbl (about 1781 $Nm^3/m^3$). Additionally or alternately, the conditions can include one or more of a temperature from about 600° F. (about 343° C.) to about 815° F. (about 435° C.), a hydrogen partial pressure from about 500 psig (about 3.5 MPag) to about 3000 psig (about 20.7 MPag), a liquid hourly space velocity from about 2 $hr^{-1}$ to about 10 $hr^{-1}$, and a hydrogen treat gas rate from about 1200 scf/bbl (about 200 $Nm^3/m^3$) to about 6000 scf/bbl (about 1020 $Nm^3/m^3$).

Further additionally or alternately, the conditions for dewaxing can be selected based on the conditions for a preceding reaction in the stage, such as hydrocracking conditions or hydrotreating conditions. Such conditions can be further modified using a quench between previous catalyst bed(s) and the bed for the dewaxing catalyst. Instead of operating the dewaxing process at a temperature corresponding to the exit temperature of the prior catalyst bed, a quench can be used to reduce the temperature for the hydrocarbon stream at the beginning of the dewaxing catalyst bed. One option can be to use a quench to have a temperature at the beginning of the dewaxing catalyst bed that is about the same as the outlet temperature of the prior catalyst bed. Another option can be to use a quench to have a temperature at the beginning of the dewaxing catalyst bed that is at least about 10° F. (about 6° C.) lower than the prior catalyst bed, for example at least about 20° F. (about 11° C.) lower, at least about 30° F. (about 17° C.) lower, or at least about 40° F. (about 22° C.) lower.

Reaction Products

In various embodiments, the hydrocracking conditions in a light feed hydrocracking reaction system can be sufficient to attain a conversion level of at least about 50%, for example at least about 60%, at least about 70%, at least about 80%, or at least about 85%. Additionally or alternately, the hydrocracking conditions in the reaction system can be sufficient to attain a conversion level of not more than about 85%, for example not more than about 80%, not more than about 75%, or not more than about 70%. Further additionally or alternately, the hydrocracking conditions in the high-conversion/second hydrocracking stage can be sufficient to attain a conversion level from about 50% to about 85%, for example from about 55% to about 70%, from about 60% to about 85%, or from about 60% to about 75%. As used herein, the term "conversion level," with reference to a feedstream being hydrocracked, means the relative amount of change in boiling point of the individual molecules in the feedstream from above 400° F. (204° C.+) to 400° F. or below (204° C.−). Conversion level can be measured by any appropriate means and, for a feedstream whose minimum boiling point is at least 400.1° F. (204.5° C.), can represent the average proportion of material that has passed through the hydrocracking process and has a boiling point less than or equal to 400.0° F. (204.4° C.), compared to the total amount of hydrocracked material.

In various embodiments, a light feed hydrocracker reaction system can be used to produce at least a converted product and an unconverted product. The converted product can correspond to a product with a boiling point below about 400° F. (about 204° C.−), while the unconverted product can correspond to a product with a boiling point above about 400° F. (about 204° C.+). Note that the temperature for the conversion level can differ from the temperature for defining a converted product and an unconverted product.

A converted product can be a majority of the product generated by the light feed hydrocracker reaction system. An example of a converted product can be a naphtha boiling range product. In an embodiment, a converted product can have a boiling range from about 75° F. (about 24° C.) to about 400° F. (about 204° C.). Additionally or alternately, an initial boiling point for a converted product can be at least about 75° F. (about 24° C.), for example at least about 85° F. (about 30° C.) or at least about 100° F. (about 38° C.). Further additionally or alternately, a final boiling point can be about 425° F. (about 218° C.) or less, for example about 400° F. (about 204° C.) or less, about 375° F. (about 191° C.) or less, or about 350° F. (about 177° C.) or less. Additionally or alternately, it may be desirable to create multiple products from an unconverted fraction. For example, a light naphtha product can have a final boiling point of about 325° F. (about 163° C.) or less, for example about 300° F. (about 149° C.) or less or about 275° F. (about 135° C.) or less. Such a light naphtha product could be complemented by a heavy naphtha product. A heavy naphtha product can have a boiling range starting at the final boiling point for a light naphtha product, and a final boiling point as described above.

Another option for characterizing a converted product, separately or in addition to an initial and/or final boiling point, can be to characterize one or more intermediate temperatures in a boiling range. For example, a temperature where about 10 wt % of the converted product will boil can be referred to as a T10 boiling point. In such an embodiment, the T10 boiling point for the converted product can be at least about 100° F. (about 38° C.), for example at least about 115° F. (about 46° C.) or at least about 125° F. (about 52° C.). Additionally or alternately, the T90 boiling point (where about 90 wt % of the converted product will boil) can be about 375° F. (about 191° C.) or less, for example about 350° F. (about 177° C.) or less or about 325° F. (about 163° C.) or less. In some situations, intermediate boiling point values such as T10 and/or T90 values can be beneficial for characterizing a hydrocarbon fraction, as intermediate boiling point values may be more representative of the overall characteristics.

The amount of converted product can vary depending on the reaction conditions. In an embodiment, at least about 50 wt % of the total liquid product generated by the light feed hydrocracker reaction system can be a converted product, for example at least about 60 wt %, at least about 70 wt %, at least about 80 wt %, or at least about 85 wt %. Additionally or alternately, about 95 wt % or less of the total liquid product can be a converted product, for example about 85 wt % or less, about 75 wt % or less, or about 65 wt % or less.

An unconverted product from the light feed hydrocracker reaction system can also be characterized in various ways. In an embodiment, an unconverted product can be a product with a boiling range from about 400° F. (about 204° C.) to about 870° F. (about 466° C.). Additionally or alternately, an initial boiling point for an unconverted product can be at least about 350° F. (about 177° C.), for example at least about 375° F. (about 191° C.), at least about 400° F. (about 204° C.), at least about 425° F. (about 218° C.), or at least about 450° F. (about 232° (C). Further additionally or alternately, a final boiling point can be about 830° F. (about 443° C.) or less, for example about 800° F. (about 427° C.) or less, about 775° F. (about 413° C.) or less, or about 750° F. (about 399° C.) or less.

Another option for characterizing an unconverted product, separately or in addition to an initial and/or final boiling point, can be to characterize one or more intermediate temperatures in a boiling range. For example, a T10 boiling point for the unconverted product can be at least about 325° F. (about 163° C.), for example at least about 350° F. (about 177° C.), at least about 375° F. (about 191° C.), at least about 400° F. (about 204° C.), at least about 425° F. (about 218° C.), or at least about 450° F. (about 232° C.). Additionally or alternately, the T90 boiling point for the unconverted product can be about 700° F. (about 371° C.) or less, for example about 675° F. (about 357° C.) or less, about 650° F. (about 343° C.) or less, or about 625° F. (about 329° C.) or less.

The amount of unconverted product can vary depending on the reaction conditions. In an embodiment, at least about 5 wt % of the total liquid product generated by the light feed hydrocracker reaction system can be an unconverted product, for example at least about 10 wt %, at least about 20 wt %, or at least about 30 wt %. Additionally or alternately, about 50 wt % or less of the total liquid product can be an unconverted product, for example about 45 wt % or less, about 40 wt % or less, about 35 wt % or less, about 30 wt % or less, about 25 wt % or less, or about 20 wt % or less.

It is noted that the initial boiling point for the unconverted product can be dependent on how the cut point is defined for the various products generated in the fractionator. For example, if a fractionator is configured to generate a converted product and an unconverted product, the initial boiling point for the unconverted product can be related to the final boiling point for the naphtha product. Similarly, a T190 boiling point for a converted product may be related in some manner to a T10 boiling point for the unconverted product from the same fractionator.

Although the boiling ranges above are described with reference to a converted product and an unconverted product, it is understood that a plurality of different (converted and/or unconverted) cuts could be generated by the fractionator while still satisfying the above ranges. For example, a product slate from a fractionator could include a light naphtha and a heavy naphtha as converted products, and the withdrawn portion of the unconverted fraction can correspond to a diesel product. Still other combinations of products could also be generated.

In an additional or alternate embodiment, the cloud point for an unconverted product withdrawn from the reaction system can be characterized. For example, a withdrawn unconverted product can have a cloud point of about 18° F. (about −7° C. or less, for example about 12° F. (about −11° C.) or less, about 6° F. (about −14° C.) or less, or about 0° F. (about −18° C.) or less. Additionally or alternately, the cloud point of a withdrawn unconverted product can be dependent on the amount of unconverted product withdrawn relative to the amount of feed. For example, if the withdrawn amount of unconverted product corresponds to from about 5 wt % to about 15 wt % of the feed, the cloud point of the withdrawn unconverted product can be about 30° F. (about 16° C.) lower than the cloud point of the feed. Additionally or alternately, if the withdrawn amount of unconverted product corresponds to from about 10 wt % to about 25 wt % of the feed, the cloud point of the withdrawn unconverted product can be about 20° F. (about 11° C.) lower than the cloud point of the feed. Further additionally or alternately, if the withdrawn amount of unconverted product corresponds to from about 20 wt % to about 35 wt % of the feed, the cloud point of the withdrawn unconverted product can be about 10° F. (about 6° C.) lower than the cloud point of the feed.

Other Embodiments

Additionally or alternately, the present invention can include one or more of the following embodiments.

Embodiment 1. A method for producing a naphtha product and an unconverted product, comprising:

exposing a first feedstock to a first hydrocracking catalyst in a first reaction vessel under first hydrocracking conditions to form a first hydrocracked effluent including at least a first liquid phase portion, at least about 60 wt % of the first feedstock boiling above about 400° F. (about 204° C.) and at least about 60 wt % of the first feedstock boiling below about 650° F. (about 343° C.), the first hydrocracking catalyst comprising Ni, Mo, and W on an acidic support, the ratio of Mo to W being from about 2:1 to about 1:2;

fractionating the first liquid phase portion and at least a portion of a second liquid phase portion to form a first naphtha fraction and a first unconverted fraction, the first naphtha fraction corresponding to at least about 80 wt % of the first feedstock and having a final boiling point of about 400° F. (about 204° C.) or less;

withdrawing a portion of the first unconverted fraction as a first unconverted product, a weight of the withdrawn first unconverted product corresponding to from about wt % to about 15 wt % of the first feedstock, the withdrawn first unconverted product having an initial boiling point of at least about 400° F. (about 204° C.);

separating at least a portion of the remaining portion of the first unconverted fraction as a second feedstock;

exposing the second feedstock to a second hydrocracking catalyst in a second reactor vessel under second hydrocracking conditions to form a second hydrocracked effluent including at least the second liquid phase portion; and separating the second hydrocracked effluent to produce the second liquid phase portion;

wherein the temperature of the second hydrocracking conditions is at least about 20° F. (11° C.) less than the temperature of the first hydrocracking conditions, and wherein the temperature of the first hydrocracking conditions at start-of-run is less than about 710° F. (377° C.).

Embodiment 2. A method for producing a naphtha product and an unconverted product, comprising:

exposing a first feedstock to a first catalyst in a first reaction vessel under hydrotreating conditions to form a first reactor effluent;

exposing at least a portion of the first reactor effluent to a first hydrocracking catalyst in a second reaction vessel under first hydrocracking conditions to form a first hydrocracked effluent;

including at least a first liquid phase portion, at least about 60 wt % of the first feedstock boiling above about 400° F. (about 204° C.) and at least about 60 wt % of the first feedstock boiling below about 650° F. (about 343° C.), and the first hydrocracking catalyst comprising Ni, Mo, and W on an acidic support, the ratio of Mo to W being from about 2:1 to about 1:2;

fractionating the first liquid phase portion and at least a portion of a second liquid phase portion to form a first naphtha fraction and a first unconverted fraction, the first naphtha fraction corresponding to at least about 80 wt % of the first feedstock and having a final boiling point of about 400° F. (about 204° C.) or less;

withdrawing a portion of the first unconverted fraction as a first unconverted product, a weight of the withdrawn first unconverted product corresponding to from about 5 wt % to about 15 wt % of the first feedstock, the withdrawn first unconverted product having an initial boiling point of at least about 400° F. (about 204° C.);

separating at least a portion of the remaining portion of the first unconverted fraction as a second feedstock;

exposing the second feedstock to a second hydrocracking catalyst in a third reaction vessel under second hydrocracking conditions to form a second hydrocracked effluent including at least the second liquid phase portion; and separating the second hydrocracked effluent to produce the second liquid phase portion;

wherein the temperature of the second hydrocracking conditions is at least about 20° F. (11° C.) less than the temperature of the first hydrocracking conditions, and wherein the temperature of the first hydrocracking conditions at start-of-run is less than about 710° F. (377° C.).

Embodiment 3. The method of embodiment 1, wherein the first reaction vessel further contains a hydrotreating catalyst.

Embodiment 4. The method of embodiment 2, wherein the first catalyst is a hydrotreating catalyst.

Embodiment 5. The method of embodiment 2, wherein the first catalyst is a hydrocracking catalyst.

Embodiment 6. The method of embodiment 4, wherein the first reaction vessel also contains a hydrocracking catalyst.

Embodiment 7. The method of any preceding embodiment, wherein the second hydrocracked effluent is separated into at least a second naphtha fraction and a second unconverted fraction, and at least a portion of the second unconverted fraction is used as the second liquid phase portion.

Embodiment 8. The method of embodiment 7, wherein the second naphtha fraction corresponds to from about 50 wt % to about 80 wt % of the second feedstock and has a final boiling point of about 400° F. (204° C.)

Embodiment 9. The method of any preceding embodiment, wherein at least about 80 wt % of at least one of the first feedstock and the second feedstock boils below about 700° F. (371° C.).

Embodiment 10. The method of any preceding embodiment, wherein a weight of the first unconverted product corresponds to less than about 25 wt % of the first feedstock.

Embodiment 11. The method of any preceding embodiment, wherein at least a portion of the second liquid phase portion is separated as a second unconverted product.

Embodiment 12. The method of embodiment 11, wherein a weight of the second unconverted product corresponds to from about 20 wt % to about 50 wt % of the second feedstock.

Embodiment 13. The method of any preceding embodiment, wherein at least one of the first unconverted product and the second unconverted product has a T10 boiling point of at least about 425° F. (218° C.).

Embodiment 14. The method of any preceding embodiment, wherein the T90 boiling point of at least one of the first unconverted product and the second unconverted product is about 700° F. (371° C.) or less.

Embodiment 15. The method of any preceding embodiment, wherein about 25 wt % or less of at least one of the first unconverted product and the second unconverted product boils above about 600° F. (316° C.).

Embodiment 16. The method of any of embodiments 1 and 3-15, wherein the first reaction vessel further contains a dewaxing catalyst.

Embodiment 17. The method of any of embodiments 2-15, wherein the second reaction vessel further contains a dewaxing catalyst.

Embodiment 18. The method of any of embodiments 16-17, wherein the dewaxing catalyst comprises ZSM-48, ZSM-23, zeolite Beta, or a combination thereof.

Embodiment 19. The method of any preceding embodiment, wherein the first feedstock is comprised of a light cycle oil with a T10 boiling point of at least 300° F. (149° C.) and a T90 boiling point less than or equal to 650° F. (343° C.).

Embodiment 20. The method of any preceding embodiment, wherein the first feedstock consists essentially of a light cycle oil.

Examples of Reaction System Configurations

FIG. 1 shows an example of a two stage reaction system 100 for producing a converted and unconverted product according to an embodiment of the invention. In FIG. 1, a first stage of a two stage hydrocracking system is represented by reactors 110 and 120. A hydrocarbon feed 112 and a hydrogen-containing stream 114 are fed into reactor 110. Hydrocarbon feed 112 and hydrogen-containing stream 114 are shown as being combined prior to entering reactor 110, but these streams can be introduced into reactor 110 separately, together, or in any other convenient manner. Reactor 110 can contain one or more beds of hydrotreating and/or hydrocracking catalyst. The feed 112 can be exposed to the hydrotreating and/or hydrocracking catalyst under effective hydrotreating and/or hydrocracking conditions. The entire effluent 122 from reactor 110 can then be cascaded into reactor 120. Optionally, an additional hydrogen-containing stream 124 can be added to reactor 120, such as by adding additional hydrogen-containing stream 124 to first reactor effluent 122. Reactor 120 can also include one or more beds of hydrotreating and/or hydrocracking catalyst. Optionally, reactor 120 can also include one or more beds of dewaxing catalyst 128 downstream from the hydrocracking catalyst in reactor 120. Optionally, a quench stream 127 can be included prior to the optional dewaxing catalyst bed(s) 128, such as a hydrogen-containing quench stream.

The hydrocracked effluent 132 from reactor 120 can be passed into separator 130 for separation into a gas phase portion 135 and a liquid phase portion 142. The gas phase portion 135 can be used in any convenient manner, such as by scrubbing the gas phase portion to allow for recovery and recycle of some/all of the unreacted hydrogen in gas phase portion 135. Liquid phase portion 142 can be sent to fractionator 140 for fractionation into at least a converted portion and an unconverted portion. In the embodiment shown in FIG. 1, fractionator 140 produces a light naphtha portion 146 and a heavy naphtha portion 147 as converted portions. Fractionator 140 also produces a bottoms or unconverted portion 152. An unconverted product stream 155 can be to withdrawn from unconverted portion 152. The unconverted product stream 155 can be a diesel product generated by the reaction system. The remainder of unconverted portion 152 can be used as the input for reactor 150, which serves as the second stage in the reaction system. An optional hydrogen-containing stream 154 can also be introduced into reactor 150. The input into reactor 150 can be exposed to one or more beds of hydrocracking and/or hydrotreating catalyst in reactor 150. The effluent 162 from reactor 150 can be separated in separator 160 to form a gas phase portion 165 and a liquid phase portion 172. The gas phase portion 165 can be used in any convenient manner, such as by scrubbing the gas phase portion to allow for recovery and recycle of some/all of the hydrogen in gas phase portion 165. The liquid phase portion 172 can be fractionated in fractionator 140. The liquid phase portion 172 can be introduced into fractionator 140 in any convenient manner. For ease of display in FIG. 1, liquid phase portion 172 is shown as entering the fractionator separately from stream 142. Liquid phase portion 172 and liquid phase portion 142 can alternatively be combined prior to entering fractionator 140.

Figure 2:
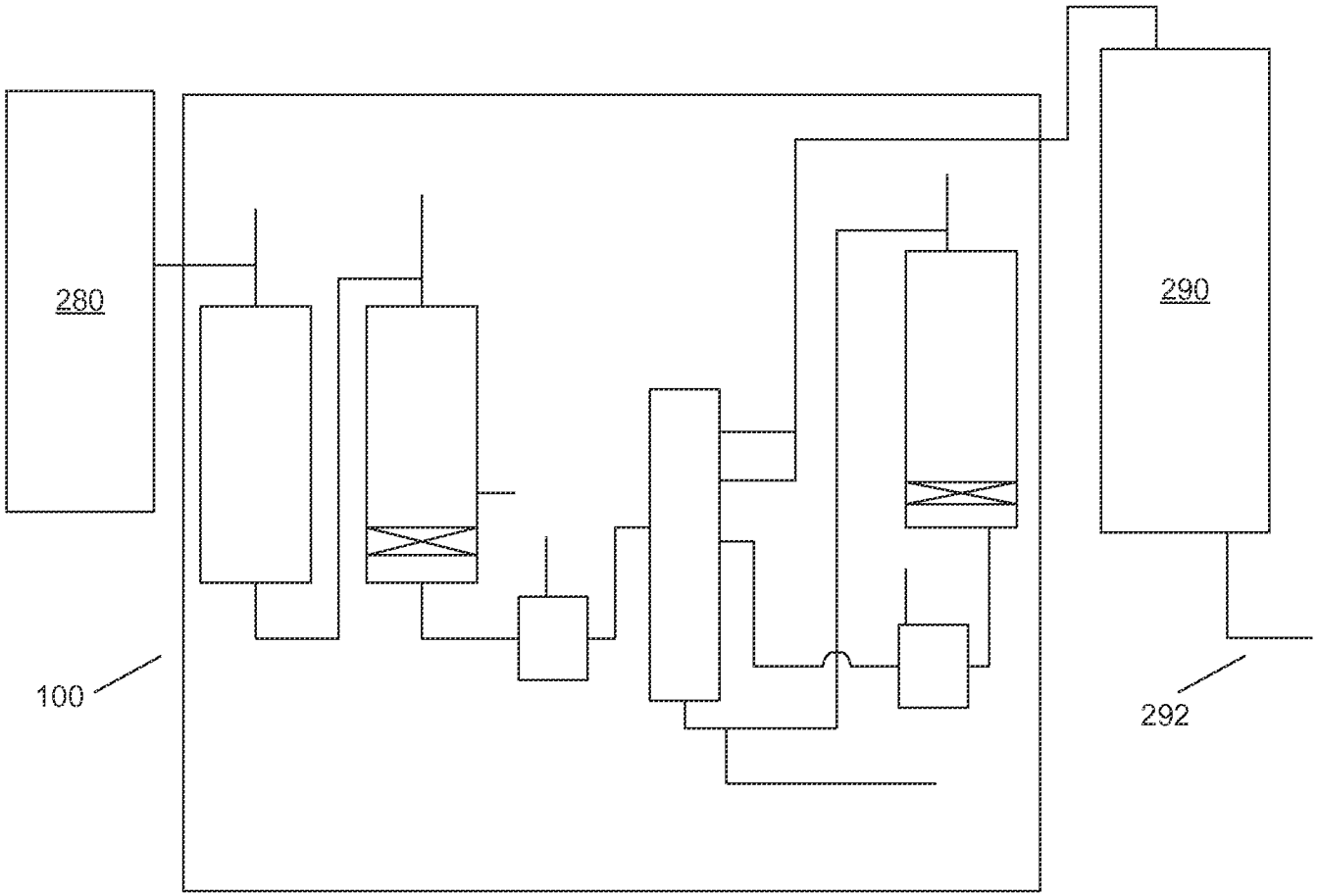
FIG. 2 schematically shows an example of a reaction system suitable for processing of a hydrocarbon feed according to the invention.

FIG. 2 shows the integration of a reaction system such as the reaction system in FIG. 1 with other refinery processes. In FIG. 2, the reaction system 100 shown in FIG. 1 is represented within the central box. in FIG. 2, the input feedstream to reaction system 100 corresponds to a distillate output from a fluid catalytic cracking (FCC) unit 280. One of the potential outputs from an FCC unit 280 can be a distillate portion that has a boiling range in the same vicinity as an atmospheric gas oil. However, a naphtha stream generated by hydrocracking of an FCC distillate output can lead to a naphtha with a relatively low octane rating. In order to achieve a higher octane rating, the naphtha output from reaction system 100 can be used as a feed to a reforming reactor 290. The reforming reactor 290 can generate a naphtha output stream 292 with an improved octane rating relative to the octane rating of the naphtha stream from the reaction system 100.

Processing Examples—Simulations

A series of simulations were performed to demonstrate the potential benefits of processing with a catalyst according to the invention. The simulations represented a configuration similar to the configuration shown in FIG. 1 in the simulations, the first reactor was modeled as containing a hydrotreatment catalyst. The catalyst in the second reactor was varied to demonstrate the benefit of catalysts according to the invention. The third reactor was modeled as containing a hydrocracking catalyst suitable for use in relatively sweet service. The reactors did not include any optional dewaxing catalyst. The simulated feedstock represented a light cycle oil from a fluid catalytic cracking unit.

In the simulations, three types of catalysts were modeled in the second reactor. One catalyst corresponded to a hydrocracking catalyst with NiMo as supported metals. A second catalyst corresponded to a hydrocracking catalyst with NiW as supported metals. A third catalyst corresponded to a hydrocracking catalyst with NiMoW as supported metals, with about a 1:1 molar ratio of Mo to W. Measured desulfurization activities were used to determine relative activity values for each type of metal on a supported hydrocracking catalyst. Based on the measured activities, the NiMo catalyst was assigned a relative desulfurization activity of about 0.62; the NiW catalyst was assigned a relative desulfurization activity of about 0.75; and the NiMoW catalyst was assigned a relative desulfurization activity of about 1.00. In the model, the hydrocracking activity was not influenced by the type of supported metal, so the supported metals changed only the desulfurization activity. Because the temperature was held constant in the second reactor, the amount of naphtha product, diesel product, and light ends make was also approximately the same. The difference between the simulations corresponds to the difference in sulfur content.

TABLE 1

| Fixed Rxr Temp | | Base Case | Catalyst A | Catalyst B |
|---|---|---|---|---|
| R2 Catalyst type | | NiMo | NiW | NiMoW |
| Rel. HDS Activity | | 0.62 | 0.75 | 1.00 |
| R1 WABT | ° F. | 676 | 676 | 676 |

TABLE 1-continued

| Fixed Rxr Temp | | Base Case | Catalyst A | Catalyst B |
|---|---|---|---|---|
| R2 WABT | ° F. | 700 | 700 | 700 |
| R3 WABT | ° F. | 604 | 604 | 604 |
| R1 Effluent S content | wppm | 132 | 132 | 132 |
| R2 Effluent S content | wppm | 10.9 | 7.8 | 4.1 |
| Diesel Sulfur content | wppm | 21.2 | 15.1 | 7.9 |
| Diesel Yield | vol % | 44.2 | 44.2 | 44.2 |
| Naphtha Yield | vol % | 68.8 | 68.8 | 68.8 |
| C1-C4 Gas Yield | wt % | 6.6 | 6.6 | 6.6 |

Table 1 shows details from a first series of simulations. In this first series, the temperature in each reactor was held constant while the catalyst was varied. Since only the catalyst in the second reactor was varied, the amount of desulfurization in the first reactor was relatively constant in the first series of simulations.

As shown in Table 1, the catalyst according to the invention (Catalyst B) resulted in a diesel sulfur content of less than about 10 wppm. By contrast, the comparative catalysts resulted in relatively higher sulfur contents above about 10 wppm, which can be an ultra low sulfur diesel target. As a result, for the conditions selected in Table 1, only the catalyst according to the invention would produce a diesel product that can meet a desired ultra low sulfur diesel target.

Table 2 shows details from a second series of simulations. In this second series, the temperature in the second reactor was varied to achieve approximately constant sulfur content in the diesel product. Due to the lower relative activity of the other catalysts, an increased temperature was used to compensate in those simulations.

TABLE 2

| Fixed Product Sulfur | | Base Case | Catalyst A | Catalyst B |
|---|---|---|---|---|
| R2 Catalyst type | | NiMo | NiW | NiMoW |
| Rel. HDS Activity | | 0.62 | 0.75 | 1.00 |
| R1 WABT | ° F. | 676 | 676 | 676 |
| R2 WABT | ° F. | 732 | 718 | 700 |
| R3 WABT | ° F. | 604 | 604 | 604 |
| R1 Effluent S content | wppm | 132 | 132 | 132 |
| R2 Effluent S content | wppm | 3.3 | 3.7 | 4.1 |
| Diesel Sulfur content | wppm | 7.8 | 7.9 | 7.9 |
| Diesel Yield | LV % | 29.2 | 36.9 | 44.2 |
| Naphtha Yield | LV % | 84.5 | 76.4 | 68.8 |
| C1-C4 Gas Yield | wt % | 8.4 | 7.5 | 6.6 |

As shown in Table 2, achieving the desired diesel sulfur content using the catalysts A and Base Case results in a substantial reduction in diesel yield. Further, the increased temperature required to meet the desired diesel sulfur content results in an increased amount of light ends, as shown by the $C_1$-$C_4$ gas yield. This demonstrates the flexibility of a catalyst according to the invention. Depending on the desired ratio of naphtha yield to diesel yield, the temperature in the second reactor can be adjusted to produce the diesel yields while also meeting a desired sulfur specification.

Process Example 2—Feed Flexibility

Table 2 also shows a more general property of the invention. In various embodiments, the temperatures in the first hydrocracking stage can be varied to modify the unconverted product (such as diesel) yield from the reaction. Due in part to the increased hydrodesulfurization ability of a catalyst according to the invention, several types of hydrocracking operating regimes are available. For example, a first hydrocracking operating regime can be used to process feeds at a higher start-of-run temperature. The higher start-of-run temperature can be useful for producing a higher proportion of naphtha. A second run can then be performed with a lower start-of-run temperature, in order to produce a higher proportion of an unconverted product. Alternately, the first run can have the lower start-of-run temperature and the second run can have the higher start-of-run temperature.

In an embodiment, the start-of-run temperature of the first hydrocracking stage can be varied to differ by at least about 10° C., for example at least about 15° C. or at least about 20° C., in consecutive runs. When the temperature of the first hydrocracking stage is varied, the feedstock can be the same or different for the different processing conditions.

If a feedstock with a similar boiling point profile is used in the two runs, the difference in start-of-run temperatures can be used to vary the proportion of naphtha and unconverted product. For example, an increase in start-of-run temperature of at least about 10° C. can be used to increase the amount of naphtha. product by at least about 10 wt %. Additionally or alternately, an increase in start-of-run temperature of at least about 15° C. can be used to increase the amount of naphtha product by at least about 15 wt %. Further additionally or alternately, an increase in start-of-run temperature of at least about 20° C. can be used to increase the amount of naphtha product by at least about 20 wt %. Still further additionally or alternately, if a feedstock with a different boiling point profile is used in the two runs, the difference in start-of-run temperatures can be used to maintain a desired product slate.

Considering things in a slightly different way, changing the start-of-run temperature can, in some embodiments, modify the amount/yield of unconverted product generated. For example, an increase in start-of-run temperature of at least about 10° C. can be used to decrease the amount of unconverted product by at least about 10 wt %. Additionally or alternately, an increase in start-of-run temperature of at least about 15° C. can be used to decrease the amount of unconverted product by at least about 15 wt %. Further additionally or alternately, an increase in start-of-run temperature of at least about 20° C. can be used to decrease the amount of unconverted product by at least about 20 wt %. Still further additionally or alternately, if a feedstock with a different boiling point profile is used in the two runs, the difference in start-of-run temperatures can be used to maintain a desired product slate.

Considering things in another slightly different way, modifying the start-of-run temperature between runs can allow for modification of a product slate. For example, a lower start-of-run temperature can be used to produce a naphtha product that corresponds to at least about 70 wt % of the feedstock, e.g., at least about 75 wt %, at least about 80 wt %, or at least about 85 wt %. Additionally or alternately, the lower start-of-run temperature can be used to produce an unconverted product that corresponds to at least about 5 wt % of the feedstock, and that typically also corresponds to about 25 wt % or less of the feedstock, for example about 20 wt % or less, about 15 wt % or less, or about 10 wt % or less. Alternately, a higher start-of-run temperature can be used to produce a naphtha product that corresponds to at least about 40 wt % of the product, for example at least about 50 wt %, at least about 55 wt %, or at least about 60 wt %. In such embodiments, the naphtha product can additionally or alternately correspond to about 80 wt % or less of the feedstock, for example about 75 wt % or less, about 70 wt % or less, about 65 wt % or less, or about 60 wt % or less. Further additionally or alternately, the higher start-of-run temperature can be used to produce an unconverted product that corresponds to at least about 15 wt % of the feedstock, for example at least about 20 wt %, at least about 25 wt %, or at least about 30 wt %. Further additionally or alternately, the unconverted product can correspond to about 50 wt % or less of the feedstock, for example about 45 wt % or less, about 40 wt % or less, about 35 wt % or less, about 30 wt % or less, or about 20 wt % or less.

Although the present invention has been described in terms of specific embodiments, it is not so limited. Suitable alterations/modifications for operation under specific conditions should be apparent to those skilled in the art. It is therefore intended that the following claims be interpreted as covering all such alterations/modifications as fall within the true spirit/scope of the invention.

What is claimed is:

1. A method for producing a naphtha product and an unconverted product, comprising:

exposing a first feedstock to a first hydrocracking catalyst in a first reaction vessel under first hydrocracking conditions to form a first hydrocracked effluent including at least a first liquid phase portion, at least about 60 wt % of the first feedstock boiling above about 400° F. (about 204° C.) and at least about 60 wt % of the first feedstock boiling below about 650° F. (about 343° C.), the first hydrocracking catalyst comprising Ni, Mo, and W on an acidic support, the ratio of Mo to W being from about 2:1 to about 1:2, the first reaction vessel further containing a dewaxdewaxing catalyst;

fractionating the first liquid phase portion and at least a portion of a second liquid phase portion to form a first naphtha fraction and a first unconverted fraction, the first naphtha fraction corresponding to at least about 80 wt % of the first feedstock and having a final boiling point of about 400° F. (about 204° C.) or less;

withdrawing a portion of the first unconverted fraction as a first unconverted product, a weight of the withdrawn first unconverted product corresponding to from about 5 wt % to about 15 wt % of the first feedstock, the withdrawn first unconverted product having an initial boiling point of at least about 400° F. (about 204° C.);

separating at least a portion of the remaining portion of the first unconverted fraction as a second feedstock;

exposing the second feedstock to a second hydrocracking catalyst in a second reactor vessel under second hydrocracking conditions to form a second hydrocracked effluent including at least the second liquid phase portion; and separating the second hydrocracked effluent to produce the second liquid phase portion;

wherein the temperature of the second hydrocracking conditions is at least about 20° F. (11° C.) less than the temperature of the first hydrocracking conditions, and wherein the temperature of the first hydrocracking conditions at start-of-run is less than about 710° F. (377° C.).

2. The method of claim 1, wherein the second hydrocracked effluent is separated into at least a second naphtha fraction and a second unconverted fraction, and at least a portion of the second unconverted fraction is used as the second liquid phase portion.

3. The method of claim 2, wherein the second naphtha fraction corresponds to from about 50 wt % to about 80 wt % of the second feedstock and has a final boiling point of about 400° F. (204° C.).

4. The method of claim 1, wherein at least about 80 wt % of at least one of the first feedstock and the second feedstock boils below about 700° F. (371° C.).

5. The method of claim 1, wherein a weight of the first unconverted product corresponds to less than about 25 wt % of the first feedstock.

6. The method of claim 1, wherein at least a portion of the second liquid phase portion is separated as a second unconverted product.

7. The method of claim 6, wherein a weight of the second unconverted product corresponds to from about 20 wt % to about 50 wt % of the second feedstock.

8. The method of claim 6, wherein at least one of the first unconverted product and the second unconverted product has a T10 boiling point of at least about 425° F. (218° C.).

9. The method of claim 8, wherein the T90 boiling point of at least one of the first unconverted product and the second unconverted product is about 700° F. (371° C.) or less.

10. The method of claim 9, wherein about 25 wt % or less of at least one of the first unconverted product and the second unconverted product boils above about 600° F. (316° C.).

11. The method of claim 1, wherein the dewaxing catalyst comprises ZSM-48, ZSM-23, zeolite Beta, or a combination thereof.

12. The method of claim 1, wherein the first feedstock is comprised of a light cycle oil with a T10 boiling point of at least 300° F. (149° C.) and a T90 boiling point less than or equal to 650° F. (343° C.).

13. The method of claim 12, wherein the first feedstock consists essentially of a light cycle oil.

14. The method of claim 1, wherein the first reaction vessel further contains a hydrotreating catalyst.

15. A method for producing a naphtha product and an unconverted product, comprising:

exposing a first feedstock to a first catalyst in a first re ion vessel under hydrotreating conditions to form a first reactor effluent;

exposing at least a portion of the first reactor effluent to a first hydrocracking catalyst in a second reaction vessel under first hydrocracking conditions to form a first hydrocracked effluent;

including at least a first liquid phase portion, at least about 60 wt % of the first feedstock boiling above about 400° F. (about 204° C.) and at least about 60 wt % of the first feedstock boiling below about 650° F. (about 343° C.), and the first hydrocracking catalyst comprising Ni, Mo, and W on an acidic support, the ratio of Mo to W being from about 2:1 to about 1:2;

fractionating the first liquid phase portion and at least a portion of a second liquid. phase portion to form a first naphtha fraction and a first unconverted fraction, the first naphtha fraction corresponding to at least about 80 wt % of the first feedstock and having a final boiling point of about 400° F. (about 204° C.) or less;

withdrawing a portion of the first unconverted fraction as a first unconverted product, a weight of the withdrawn first unconverted product corresponding to from about 5 wt % to about 15 wt % of the first feedstock, the withdrawn first unconverted product having an initial boiling point of at least about 400° F. (about 204° C.);

separating at least a portion of the remaining portion of the first unconverted fraction as a second feedstock;

exposing the second feedstock to a second hydrocracking catalyst in a third reaction vessel under second hydrocracking conditions to form a second hydrocracked effluent including at least the second liquid phase portion; and separating the second hydrocracked effluent to produce the second liquid phase portion;

wherein the temperature of the second hydrocracking conditions is at least about 20° F. (11° C.) less than the temperature of the first hydrocracking conditions, and wherein the temperature of the first hydrocracking conditions at start-of-run is less than about 710° F. (377° C.).

16. The method of claim 1, wherein the first catalyst is a hydrotreating catalyst.

17. The method of claim 16, wherein the first reaction vessel also contains a hydrocracking catalyst.

18. The method of claim 15, wherein the second hydrocracked effluent is separated into at least a second naphtha fraction and a second unconverted fraction, and at least a portion of the second unconverted fraction is used as the second liquid phase portion.

19. The method of claim 18, wherein the second naphtha fraction corresponds to from about 50 wt % to about 80 wt % of the second feedstock and has a final boiling point of about 400° F. (204° C.)

20. The method of claim 15, wherein at least about 80 wt % of at least one of the first feedstock and the second feedstock boils below about 700° F. (371°C.).

21. The method of claim 15, wherein a weight of the first unconverted product corresponds to less than about 25 wt % of the first feedstock.

22. The method of claim 15, wherein at least a portion of the second liquid phase portion is separated as a second unconverted product.

23. The method of claim 22, wherein a weight of the second unconverted product corresponds to from about 20 wt % to about 50 wt % of the second feedstock.

24. The method of claim 22, wherein at least one of the first unconverted product and the second unconverted product has a T10 boiling point of at least about 425° F. (218° C.) and a T90 boiling point of about 700° F. (371° C.) or less.

25. The method of claim 24, wherein about 25 wt % or less of at least one of the first unconverted product and the second unconverted product boils above about 600° F. (316° C.).

26. The method of claim 1, wherein the second reaction vessel further contains a dewaxing catalyst comprising ZSM-48, ZSM-23, zeolite Beta, or a combination thereof.

27. The method of claim 15, wherein the first feedstock is comprised of a light cycle oil with a T10 boiling point of at least 300° F. (149° C.) and a T90 boiling point less than or equal to 650° F. (343° C.).

28. The method of claim 27, wherein the first feedstock consists essentially of a light cycle oil.

* * * * *